US006047644A

United States Patent [19]

Malecki et al.

[11] Patent Number: 6,047,644

[45] Date of Patent: Apr. 11, 2000

[54] PROPELLANT BASED AEROSOL GENERATING DEVICE AND METHOD OF USE

[75] Inventors: Raymond J. Malecki, Perryhall; William G. Rouse, Havre De Grace, both of Md.; Daniel J. Hartman, Orlando, Fla.; Samuel Morgan, Orlando, Fla.; Tom Mills, Oviedo, Fla.

[73] Assignee: The United States of America as represented by the Secretary of the Army, Washington, D.C.

[21] Appl. No.: 09/045,968

[22] Filed: Mar. 18, 1998

[51] Int. Cl.[7] ..... F42B 12/70; F42B 12/46

[52] U.S. Cl. ..... 102/367; 102/505; 102/334; 280/741; 342/3

[58] Field of Search ..... 102/505, 334, 102/367, 345; 342/1, 3, 4; 239/654, 655; 222/630; 280/741

[56] References Cited

U.S. PATENT DOCUMENTS

| | | | |
|---|---|---|---|
| H146 | 10/1986 | Decker | 239/323 |
| H151 | 11/1986 | Rouse | 239/654 |
| H769 | 4/1990 | Rouse | 102/334 |
| H775 | 5/1990 | Rouse | 86/20.1 |
| 3,238,143 | 3/1966 | Ainsley . | |
| 3,785,674 | 1/1974 | Poole | 280/150 |
| 4,446,990 | 5/1984 | Stevenson | 222/82 |
| 4,726,295 | 2/1988 | Embury, Jr. | 102/334 |
| 5,148,173 | 9/1992 | Rouse | 342/3 |
| 5,494,312 | 2/1996 | Rink | 280/737 |
| 5,772,243 | 6/1998 | Green | 280/741 |

*Primary Examiner*—Jack W. Lavinder
*Attorney, Agent, or Firm*—Ulysses John Biffoni

[57] ABSTRACT

An aerosol generating device comprising a casing having a base end and a retainer end, with a firing primer mounted through the base end and extending into a propellant zone which contains a propellant. The firing primer is thereby detonationally connected to the propellant. A diffuser plate is mounted inside of the casing on a side of the propellant zone opposite to the firing primer. A filler area inside of the casing is adjacent to the diffuser on an opposite side to the propellant zone. The filler area contains particles of a powder having interstitial void space between the particles. A frangible end seal is attached to the casing within the retainer end, with the frangible end seal being positioned adjacent to the filler area on an opposite side of the diffuser. When activated, propellant gases expand through the diffuser into the fill area deagglomerating and fluidizing the powder particles and increasing pressure until the end seal ruptures and releases an aerosol cloud. A method for disseminating an aerosol using the device is also disclosed.

20 Claims, 1 Drawing Sheet

PROPELLANT BASED AEROSOL GENERATING DEVICE AND METHOD OF USE

GOVERNMENT INTEREST

The invention described herein may be manufactured, licensed, and used by or for the U.S. Government.

BACKGROUND OF THE INVENTION

1. Field of the Invention

The present invention relates to a device and method for aerosol dispersion. More particularly, the device and method for aerosol dispersal use propellant gas generation. Most particularly, the device and method provide a pyrotechnic, non-explosive means for propellant disseminated aerosol payloads for military and civilian purposes.

2. Brief Description of the Related Art

Aerosols are the suspension of solid particles in the atmosphere. Aerosols are used in the military to defensively position and protect combat forces. In civilian use, aerosol dispersal is used for police and fire fighting purposes. These solid particle payloads have included smokes, obscurants, riot control agents, dye indicators and similar compounds.

The military uses high explosive (HE) devices or grenades to disperse a variety of particle payloads into the atmosphere. However, HE device and grenade use creates a fragmentation hazard. In addition, both employ time delays, i.e., there is a delay from the time the grenade is fired until it explodes and creates an aerosol cloud. During military operations, a military force may be targeted by visual means, ultraviolet, infrared (IR), and millimeter (MM) wave radar sensors. To counter this targeting, various types of filler payloads are used for aerosol dissemination thereby obscuring and protecting the potential targets. These payloads include carbon fiber payloads to block energy in the MM region of the electromagnetic spectrum smokes to obscure military forces from visual detection, and brass flakes which interfere with IR tracking and target acquisition devices. The military also uses pneumatic means such as bleed air from a turbine engine to disseminate aerosols, but such systems do not provide the rapid obscuration required when targeted.

In civilian use, aerosols are dispersed by police and fire units. Police disperse riot control aerosols into crowds and as personal protectants and/or incapacitating agents. Aerosols used in fire fighting situations provide fire fighters the ability to remove fire sustaining elements from an environment, such as heat, oxygen, and the like. Aerosols currently used are provided by remote hoses and/or vehicles and generally require an initiation time delay, or are within a spray.

In view of the foregoing, improvements in the dispersal of aerosols has been desired. In addition to the improved dispersal utility, effective dispersion of particles is desired.

The present invention addresses these needs by providing a device and method for rapid solid particle aerosol dissemination into the atmosphere.

SUMMARY OF THE INVENTION

The present invention includes a device comprising: a cylindrical, or substantially cylindrical, casing having a base end and a retainer end; a firing primer mounted through the base end which extends to a propellant zone within the casing; a propellant retained within the propellant zone, the firing primer being connected to the propellant; a diffuser inside of the casing and on a side of the propellant zone opposite to the firing primer; a filler area inside of the casing, the filler area being adjacent to the diffuser on an opposite side to the propellant zone, the filler area containing particles of a powder having interstitial void space between the particles; and, a frangible end seal (rupture disk) attached to the casing retainer end, the frangible end seal being positioned adjacent to the filler area on a side opposite the diffuser.

Additionally, a method for dispersing an aerosol which provides the above described device and actuates the device is disclosed.

DETAILED DESCRIPTION OF THE PREFERRED EMBODIMENTS

Figure 1:
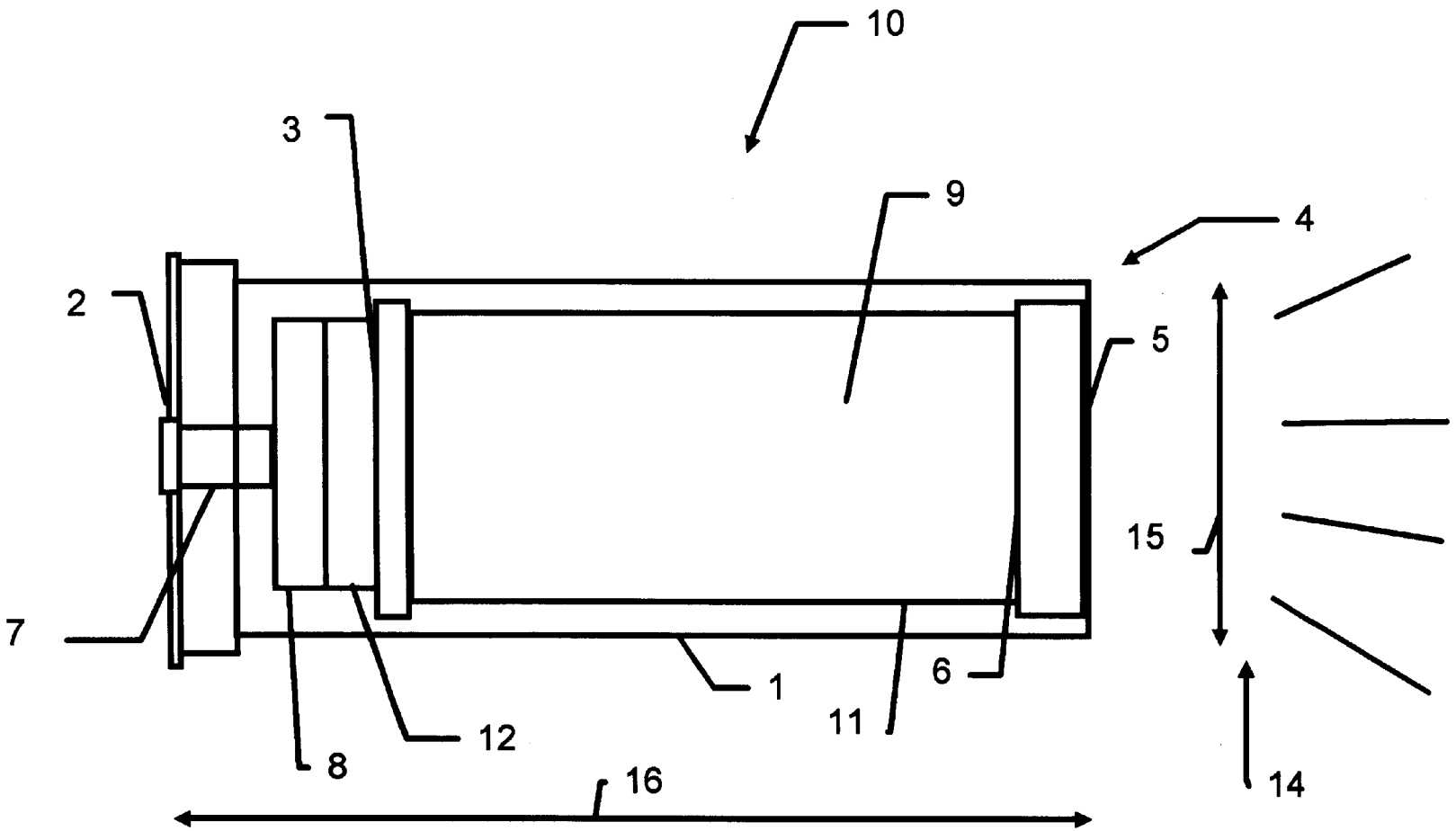
FIG. 1 is a schematic illustration of a cross-sectional view of the device of the present invention.

The present invention is a device used for aerosol dispersal and a method of aerosol dispersal using the device. The aerosol dispersal device and method permit easy handling and dissemination of the aerosols in combat and non-combat operations, and provide a rapid and efficient method for dispersal of aerosols into the atmosphere for military and civilian purposes. The device is a pyrotechnic which does not depend on explosive means such as high explosives, nor pneumatic means such as vehicle "bleed air" for proper functioning.

As seen in FIG. 1, the device 10 comprises a casing 1. The casing 1 is any material or construction which permits the containment of powder particles 9 within a filler area 11. Preferably the casing 1 is a hard, relatively strong material such as plastic, ceramic or metal. More preferably, the casing 1 comprises a metal, and most preferably the casing 1 comprises aluminum. In the preferred embodiment, the casing 1 has a cylindrical construction with a length 16 of from about 2 inches to about 6 inches, preferably from about 4 inches to about 5 inches. The diameter, or width 15, of the casing 1 is preferably from about 1 inch to about 4 inches, more preferably from about 1 inches to about 3 inches, and most preferably about 1.57 inches. The length 16 and width 15 of the casing 1 is such as to allow maximum dispersion of the powder particles 9 within the filler area 11 into an aerosol. The width 15, length 16 and other dimensions of the casing 1 may vary according to factors such as propellant strength, void spacing and the like.

The casing 1 has a base end 2 and a retainer end 4. The base end 2 contains a firing primer 7 and a propellant 8, with the firing primer 7 attached to the propellant 8 so that the propellant 8 may be ignited by the primer 7. The firing primer 7 may be any primer type which is capable of initiating burn of the propellant 8, preferably the primer 7 is a percussion primer which is fired by mechanical contact.

The propellant 8 is a non-explosive charge. As compared with high explosives (HE), the propellant 8 of the present invention is relatively slow burning. The rate of burn of the propellant 8 produces gas generation, creating excessive or large amounts of gas over a short period of time. Excessive or large amounts of gas are those amounts which are capable of effectively fluidizing the powder particles 9 as the gases from the propellant 8 travel into the filler area 11. Unlike a high yield explosive reaction, i.e., detonation, which consists of a shock wave that travels through the surrounding material, an ignited propellant reaction is a combustion reaction or deflagration that acts as a gas generator system to release kinetic energy in a controlled manner.

Propellants 8 used in the present invention include propellants such as single-base, double-base, triple-base, composite propellant, ball propellant, and similar compounds. Most preferably, the propellant 8 is double-base. Single-base propellants are low cost propellants that have a low flame temperature and low energy content, and contain such compositions as nitrocellulose. Double-base propellants are more energetic than single-base propellants, and may contain such compositions as nitrocellulose gelatinized by nitroglycerin. Triple-base propellants generally contain nitroguanidine as an additional energizer which increase the energy content for the composition without raising the flame temperature. Composite propellants contain a polymer binder, a fuel, and an oxidizer. Ball propellant contains nitrocellulose extracted from waste single-base propellant. Additional types of propellants 8 which function to fluidize the powder particles 9 for the present invention are known to those skilled in the art.

The casing 1 may further contain an open area 12 between the propellant 8 and a diffuser 3. The open area 12 allows for expansion of the propellant gases from the burning propellant which fluidize powder particles 9 out of the filler area 11 once the propellant 8 has been ignited. Preferably, the open area 12 has a volume ratio to the filter area 11 of 1 to 10, more preferably 1 to 5, even more preferably 1 to 4, and most preferably 1 to 3.

Adjacent to the open area 12 on the opposite side of the propellant 8 is the diffuser plate, or diffuser 3. The diffuser 3 is between the open area 12 and the filler area 11. The location of the diffuser 3 allows gases generated from the ignited propellant 8 to travel through the diffuser 3. The diffuser 3 is a solid material which partitions the propellant 8 from the powder particles 9. The diffuser 3 has a thin width of from about 0.0625 inches to about 0.25 inches, more preferably from about 0.125 inches to about 0.1875 inches, most preferably about 0.125 inches thick. Across the face of the diffuser 3, multiple openings or holes are placed. The holes may be any number or size, which is varied dependent on the size of the device 10 and the amount of propellant 8 and powder particles 9 used. The variations of the number and size of the holes may be readily determined by those skilled in the art. For a 40 mm cartridge, the diffuser 3 preferably has from about 2 to about 20 holes, more preferably from about 4 to about 10 holes, most preferably from about 7 holes to about 8 holes. The sizes of the holes is preferably from about 5.0 mm diameter to about 10 mm diameter, more preferably from about 7.0 mm diameter to about 8.0 mm diameter. The holes are covered by a paper thin sheet to retain the powder particles 9 and the propellant 8 in their respective areas. This sheet may be any material which facilitates this separation. The sheet may be paper, metal such as aluminum foil, fabrics and the like. Preferably, the holes are covered by adhesive backed paper. The diffuser 3 is a hard material such as plastic, ceramic or metal. Preferably, the diffuser 3 is metal. Flow rate of gases into the filler area 11 varies by the ratio of the diffuser hole area to the fill area 11.

The filler area 11 is located inside the casing 1 adjacent to the diffuser 3, on the side of the diffuser opposite the open area 12, and extends between the diffuser 3 and a frangible end seal or rupture disk 6 located at the retainer end of the casing 1. The filler area 11 is preferably from about 1.0 inches to about 3.0 inches long, more preferably about 2.5 inches long. The volume of the filler area 11 is preferably from about 1.35 $in^3$ to about 5.0 $in^3$, most preferably about 3.5 $in^3$. Powder particles 9 are located within the filler area 11.

The powder particles 9 within the filler area 11 have void areas or interstitial void space between the powder particles 9. As expanding gas from the propellant 8 flows through the diffuser 3 and into the filler area 11, the gas flows into the interstitial void space which exists between the powder particles 9. The expanding gas deagglomerates the powder particles 9 and dissipates the total mass of material. Preferably, the volume ratio of powder particles 9 to void space between the powder particles 9 within the filler area 11 is from about 20:80 to about 80:20, more preferably from about 20:80 to about 50:50, most preferably about 30:70.

The powder particles 9 include military payloads of screening obscurants, such as titanium dioxide, brass flakes, carbon flakes and fibers, graphite flakes, smoke, chaff, and the like. Additionally, civilian payloads of riot control agents, such as Ortho-chlorobenzalmalononitrile (CS) and Oleoresin Capsicm (OC), dye indicators, sticky foams, fire retardants, and the like may be used as powder particles 9 for law enforcement and firefighting uses. When the device is used to create an infrared screen, preferably the powder particles 9 comprise brass flakes. When obscurants are used, those powder particles 9 which are granules preferably have diameters ranging from about 0.5 $\mu$m to about 2.0 $\mu$m in diameter. When the particles 9 are flakes comprising irregular plate-shaped particles, preferably they have diameters ranging from about 1.0 $\mu$m to about 100 $\mu$m. When fibrous materials are used, such as carbon fibers, which are electrically conductive cylinder shaped dipoles, the diameters of the fibers preferably range from about 3.5 $\mu$m to about 20 $\mu$m.

At the retainer end 4 of the casing 1, a retaining ring 5 holds the frangible end seal (rupture disk) 6 in place adjacent to the filler area 11. The frangible end seal 6 is adjacent to a filler area 11 which holds the powder particles 9. The frangible end seal 6 retains the powder particles 9 in the casing 1 until sufficient pressure is caused by expanding gases of the propellant 8 thereby discharging the powder particles 9 through the end seal 6 thus causing a release of the powder particles 9 into an aerosol cloud 14. Preferably the frangible end seal 6 withstands pressures of from about 100 psi to about 1500 psi prior to rupture, more preferably from about 1200 psi to about 1400 psi prior to rupture, and most preferably about 1350 psi prior to rupture. The end seal 6 is any material which permits retention of the powder particles 9 in the casing 1 until a desired pressure is reached. Preferably the end seal rupture disk 6 is a hard material such as plastic, ceramic or metal. More preferably, the frangible end seal 6 comprises a metal.

In operation, as the propellant 8 burns, gases are created in the open area 12. These gases quickly blow through any thin sheet on the diffuser 3 and are released through the diffuser 3 in a controlled manner into the filler area 11. The gases flow between the powder particles 9 within the filler area 11 which causes the powder particles 9 to fluidize. As the pressure increases, the rupture disk 6 breaks, allowing the powder particles 9 to be released in an aerosol 14 into the atmosphere.

The aerosol generation may be done using the device 10 from any platform suited for the purpose, such as a truck, tank, aircraft, sea-going vessel and the like. Multiple firings of 40 mm cartridges from an automatic grenade launcher, such as the Army's M129 mounted on any type of military vehicle, could be used to create continuous trailing aerosol smoke screens. Additionally, the aerosol generation may be done by individuals, such as a soldier in the field giving field commanders greater tactical flexibility, downed aircrews who are awaiting the arrival of search and rescue teams, and the like, using a single shot pistol or multiple shotgun device.

A continuously generated aerosol plume or cloud may be created by firing multiple devices 10 within a given area. The devices 10 are preferably fired in 2 second intervals, which produces an output equivalent to an Army M56 smoke generator at its maximum IR obscurant consumption rate of 10 pounds per minute.

The device 10 provides for aerosol formation without the use of high explosives and/or the use of grenades. It provides instant dissemination of an aerosol in a localized area without fragmentation hazards. It further permits dispersion of several types of aerosols.

EXAMPLE 1

A 40 mm cartridge having the construction shown in FIG. 1 and containing an infrared (IR) screening material of brass flakes was tested. Approximately 150 grams of brass flake were placed in a filler area. Approximately 1.5 grams of propellant were used.

The 1.5 grams of propellant were ignited with a percussion primer on one side of a diffuser, which was initiated by a hammer mechanism. As the propellant burned, gases were produced, which traveled through openings in the diffuser into the filler area, allowing the diffuser to control the flow rate of the gases into the filler material and increasing the fluidity of the filler payload. As the filler payload deagglomerated, pressure in the filler area increased. At approximately 200 psi, the rupture disk burst and the filler payload was expelled from the device and disseminated as an aerosol.

The brass particles formed an aerosol cloud which attenuated infrared energies in the electromagnetic spectrum. The clouds averaged in size of about 9.5 feet long by 10.75 feet wide by 9.5 feet high.

Preliminary tests calculated a 99.4% expulsion and atmospheric dispersion efficiency. The average peak concentration was 19 $g/m^3$ as determined from 7 recorded plots of concentration verses time.

EXAMPLE 2

A computer simulation tested 15 multiple devices, as detailed in example 1, which were ignited, by simulation, individually every 2 seconds over a period of 30 seconds. In a 5 mph wind and a land neutral (Pasquill category D) condition, a cloud size of approximately 43 meters long by 10 meters wide by 8.25 meters high was predicted.

It should be understood that the foregoing summary, detailed description, examples and drawing of the invention are not intended to be limiting, but are only exemplary of the inventive features which are defined in the claims.

What is claimed is:

1. An aerosol generating device, comprising:

a casing having a base end and a retainer end;

a firing primer mounted through said base end, said primer extending to a propellant zone within said casing;

a propellant retained within said propellant zone, said firing primer being connected to said propellant;

a diffuser inside said casing and on a side of the propellant zone opposite to the firing primer;

a filler area inside said casing, the filler area being adjacent to the diffuser on a side opposite to the propellant zone, the filler area containing particles of a powder having interstitial void space between the particles; and, a frangible end seal attached to said casing, said end seal being positioned adjacent to the filler area a side opposite the diffuser.

2. The device of claim 1, further comprising an open area between said propellant zone and said diffuser.

3. The device of claim 1, wherein the relative proportion of said powder particles to said interstitial void space within said filler area has a ratio of from about 20:80 to about 80:20.

4. The device of claim 3, wherein the relative proportion of said powder particles to said interstitial void space within said filler area has a ratio of from about 20:80 to about 50:50.

5. The device of claim 4, wherein the relative proportion of said powder particles to said interstitial void space within said filler area has a ratio of about 30:70.

6. The device of claim 1, wherein said diffuser comprises a plate having multiple openings therein.

7. The device of claim 6, further comprising a thin sheet covering said diffuser.

8. The device of claim 6, wherein said diffuser has from about 2 to about 20 openings.

9. The device of claim 8, wherein said diffuser has from about 7 to about 8 openings.

10. The device of claim 6, wherein said openings are from about 5.0 mm to about 10.0 mm in diameter.

11. The device of claim 1, wherein said diffuser comprises a material selected from the group consisting of metal, plastic, and ceramic.

12. The device of claim 1, wherein said frangible end seal is capable of withstanding pressures of from about 100 psi to about 1500 psi prior to rupture.

13. The device of claim 12, wherein said frangible end seal is capable of withstanding pressures of from about 500 psi to about 1400 psi prior to rupture.

14. The device of claim 12, wherein said frangible end seal is capable of withstanding pressure of about 1350 psi prior to rupture.

15. The device of claim 1, wherein said frangible end seal comprises a metal material.

16. The device of claim 1, wherein said powder is an obscurant material selected from the group consisting of titanium dioxide, brass flakes, carbon flakes, carbon fibers, graphite flakes, and chaff.

17. The device of claim 1, wherein said powder is a riot control composition selected from the group consisting of Ortho-chlorobenzalmalononitrile (CS) and Oleoresin Capsicm (OC).

18. The device of claim 1, wherein said casing is cylindrical and is from about 2 inches to about 6 inches long.

19. The device of claim 18, wherein said casing is from about 1 to about 4 inches wide.

20. A method of disseminating an aerosol, comprising:

providing a device comprising a casing having a base end and a retainer end, a firing primer mounted through the base end which extends to a propellant zone, a propellant retained within the propellant zone, the firing primer being connected to the propellant, a diffuser inside of the casing and on a side of the propellant zone opposite to the firing primer, a filler area inside of the casing, the filler area being adjacent to the diffuser on a side opposite to the propellant zone, the filler area containing particles of a powder having interstitial void space between the particles, and, a frangible end seal attached to the casing, the frangible end seal being positioned adjacent to the filler area on a side opposite side the diffuser; and, actuating the device.

* * * * *